United States Patent [19]

Comfort

[11] 4,145,022

[45] Mar. 20, 1979

[54] BOOK HOLDER

[76] Inventor: Edward C. Comfort, Via Vianca 2 VL-316, Villa Fontana Carolina, P.R. 00630

[21] Appl. No.: 848,107

[22] Filed: Nov. 3, 1977

[51] Int. Cl.[2] ..... A47B 97/04

[52] U.S. Cl. ..... 248/453; 248/451; 248/464

[58] Field of Search ..... 248/451, 453, 460, 464

[56] References Cited

U.S. PATENT DOCUMENTS

| | | | |
|---|---|---|---|
| 631,512 | 8/1899 | Reid | 248/453 |
| 1,167,090 | 1/1916 | McCarthy | 248/464 |
| 2,101,972 | 12/1937 | Zocchi | 248/454 |
| 3,476,348 | 11/1969 | Rustad | 248/464 |
| 3,588,024 | 6/1971 | Brentzman | 248/451 |
| 3,813,075 | 5/1974 | Capper | 248/451 |

FOREIGN PATENT DOCUMENTS

| | | | |
|---|---|---|---|
| 856116 | 11/1952 | Fed. Rep. of Germany | 248/451 |
| 54814 | 1/1935 | Norway | 248/453 |

*Primary Examiner*—William H. Schultz
*Attorney, Agent, or Firm*—Robert D. Farkas

[57] ABSTRACT

A book holder utilizes an elongated bar having a T-shaped member removably secured to it. When secured, the T-shaped member extends at right angles to the length of the bar. A book may be rested on the leg portion and a half of the cross section of the T-shaped member such that the spine of the book rests upon a portion of the length of the bar. The book is maintained secured to the bar and the T-shaped section by a cord which rests between leaves of the book adjacent to the spine such that the cord may be removably affixed to the bar by way of an elastic member coupled to the cord and a hook-like element removably affixed to the bar. A U-shaped member is removably attached to a plate. The plate is pivotably secured to the bar and biased inwardly to the bar at a point where the U-shaped member is secured, thereby letting the ends of the U-shaped member hold the pages of the book open by resting on the bottom portion of the pages.

7 Claims, 4 Drawing Figures

BOOK HOLDER

BACKGROUND OF THE INVENTION

1. THE FIELD OF THE INVENTION

This invention relates to book holders and more particularly to that class of apparatus which secures a book to the holder without obscuring the printed page portions thereof.

2. DESCRIPTION OF THE PRIOR ART

The prior art abounds book holders of various types. U.S. Pat. No. 3,813,075 issued on May 28, 1974 TOK.C. CAPPER is typical of the holders heretofore available. The Capper disclosure teaches a combination book holder and book stand for use with the conventional hard cover or soft cover book. The book holder has a hollow handle which may be removeably clipped onto the end portions of the spine or the cover of books of various sizes and a support engagable with the front and back cover of the book for holding them open. A holder is provided for holding the pages of the book open at a desired page. Removably secured to the handle or legs for supporting the latter with the book held thereon in an inclined upright reading position on a supporting surface. The handle has a removeable end piece for access into the interior of the handle thus permitting the various parts of the hook holder and book stand to be stored in the handle when shipped or not in use.

U.S. Pat. No. 2,984,932 issued on May 23, 1961 to G. A. Graveline also discloses a book holder of the variety which supports a book on an incline where the pages of the book are held open by an apparatus which clips onto the end of the pages opposite the spine portion thereof.

SUMMARY OF THE INVENTION

A primary object of the present invention is to provide a book holder apparatus which when collapsed occupies a minimum of space and when assembled effectively holds books of a wide variety of sizes in an efficient manner.

Another object of the present invention is to provide a book holder which successfully holds the book pages to be later easily freed for a turning operation.

Still another object of the present invention is to provide a book holder which holds a book without engaging the space between the cover of the book and the spine of the pages. It is highly undesirable to disengage books of the paperback, bound or sheet music variety.

Yet another object of the present invention is to provide a book holder which has a component adapted to securely hold the pages of the book in an open fashion without interferring with the indicia carried by the pages.

Another object of the present invention is to provide a book holder whose page engaging apparatus may be easily manipulated to permit pages of the book to be turned.

Still another object of the present invention is to provide a book holder which supports the book in an inclined plane in a clapped position to the holder regardless of the location of page holding portion thereof.

Yet another object of the present invention is to provide an apparatus which engages the spine of the book easily and effectively independent of the displacement of the pages from side to side, thus minimizing the need to reclamp the book to the holder when a large number of pages has been shifted from one side to another.

Heretofore, book holders have been devised which have portions thereof which engage the cover of the book about its marginal edges thus tending to have the covering engaging apparatus sensitive to the number of pages that are disposed on one side of the cover or the other side of the cover. Furthermore, such old art devices were relatively inflexible and difficult to use because of the type of device used to engage the pages in an open display position. These devices were difficult to disengage from the open pages during the page-turning operation. Such old art devices also tended to be restricted in the size and shape of the books employed.

The present invention recognizes these problems and provides an apparatus which is virtually insensitive to the size of the book to be employed with the holder. Furthermore, by utilizing a thin cord which is engaged within the book, intermediate any pair of pages may be turned with great ease because the cord, being a thin element, does not interfere with the character of the book as a number of pages are disposed from one side to the other about the cord element. The present invention also employs a U shaped member whose free ends of the legs engage the pages that are open at a portion thereof adjacent the lower marginal edges, thus permitting the user to have complete visual access to the print or copy on such pages. The page-turning operation is made ultra simple by simply causing the U shaped member to be disengaged from the pages and while in the disengaged position the pages may be turned. Upon release of the U shaped member the new pair of pages are reclamped automatically. The leaf that has been turned from one side or the other now resides over the cord element whose thickness is of minimal consequence thereby allowing a large number of pages to be turned without requiring the cord element to be reset in another location between other sets of pages. Thus, the user continually turns pages from one end of the book to the other without requiring the cord element to be reset. Because a cord element is employed the height of the book is of virtually no consequence since the only other functional portion of the book holder of significance is a curved plate residing behind the book engaging the cover adjacent to the spine of the book and a T-shaped element upon which the bottom marginal edges of the cover or pages reside. The present invention is also useful in conventional operation by resting on a supporting surface or may be employed in conjunction with a stand so that the angle of use, and hence the angle in which the book is to be located, may be adjusted. Finally, the present invention by its constructional nature may be disassembled and reassembled with great ease and when disassembled may be stored occuping a minimum amount of space.

These objects as well as other objects of the present invention will become more readily apparent after reading the following description of the accompanying drawings.

DESCRIPTION OF THE PREFERRED EMBODIMENT

Figure 1:
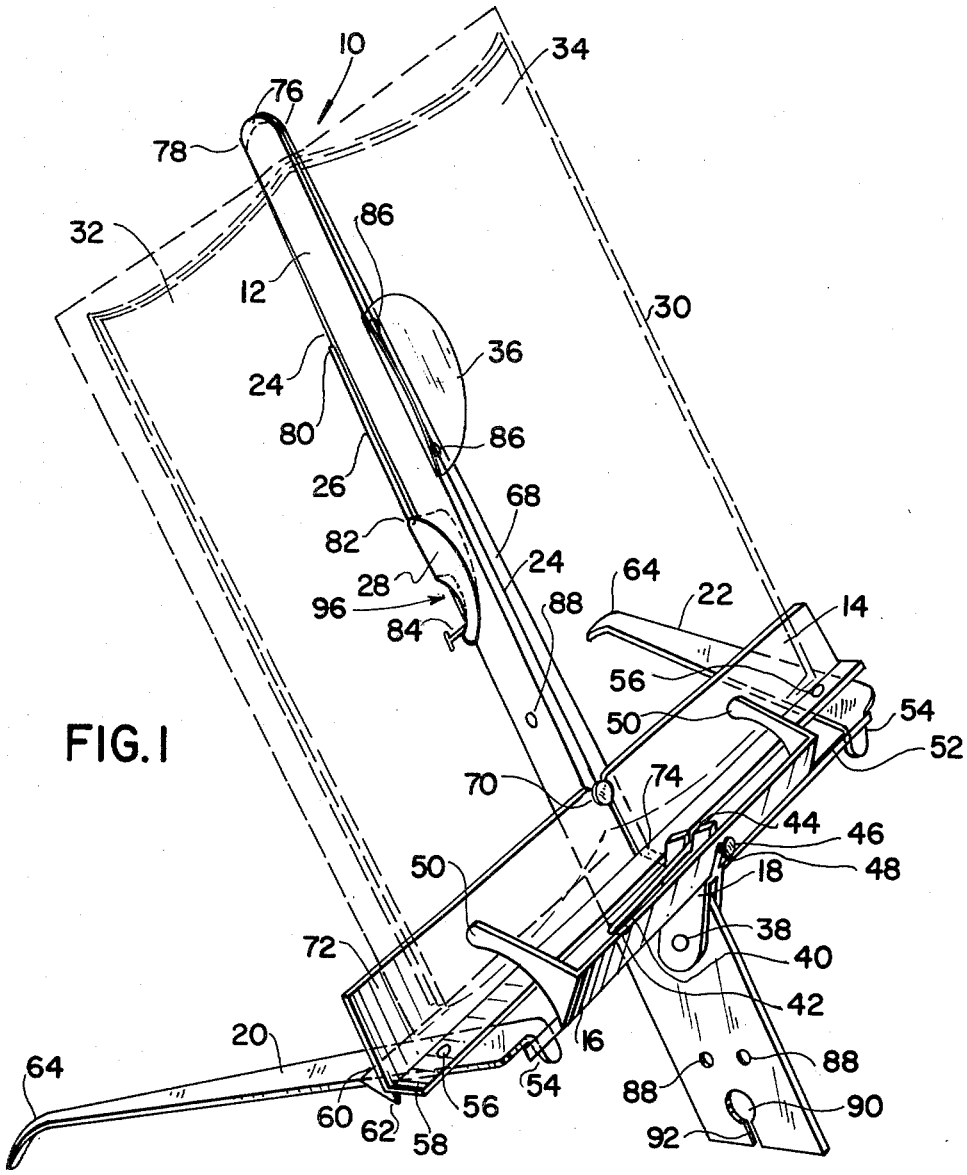
FIG. 1 is a prospective view of the present invention shown in an assembled state.

The structure and method of fabrication of the present invention is applicable to an elongated rectangular bar, having one end secured to the longitudinal axis of the bar. The other end of the bar has a groove disposed into the bar residing in a plane through which the longitudinal axis of the bar passes. The bar is equipped with a plate which is pivotably secured to the bar such that the plate is attached to one end of the helical spring, the other end of the helical spring is attached to bar such that the free end of the plate is biased inwardly toward the bar and is located adjacent to the end of the bar having the groove. An elongated T-shaped element, having a T-like cross-section, is provided having a notch in the leg of the T-shaped element and having a notch in one of the cross portions of the T-shaped element adjacent to the notch in the leg of the element. A protrusion of the fixed to the bar, complimentary shaped to the notch in the leg of the T-shaped element such that the notch in the cross portion of the T-shaped element straddles the bar and the protrusion engages the notch in the leg of the T-shaped element causing the T-shaped element to be removeably affixed to the bar and having the longitudinal axis of the T-shaped element reside at right angle to the longitudinal axis of the bar in a position where the leg is adjacent to the end of the bar in which the groove is located. A curved plate-like sheet is affixed to the bar at a location intermediate the end of the bar having the groove and on the same side of the bar to which the T shaped element may be secured by way of the projection utilizes as securing means. The T shaped bar is additionally provides with a slit engaging the leg of the T shaped element extending at right angles to the longitudinal axis of the bar. A cord-like member, preferably fabricated from a plastic monofilament, has one end fastened to the bar at a location adjacent to the pivoted end of the plate. The other end of the cord-like element is secured to an elastic member, similar to shockcord or another rubber-like material. The other end of the elastic material is secured to a hook-like element. The hook-like element is a flat sheet material, such as can be made of aluminum, having a generally U-shaped cross-section and carrying a hole which resides partly in the legs of the U-shaped cross section and in the portion of the U-shaped cross section intermediate and the leg portions thereof. The bar provided with a projection on the side of the bar opposite the side of the projection used to mount the T-shaped element. Thus, the cord element may be cause to reside on the surface of the bar running parallel to the longitudinal axis thereof up over the end of the bar carrying the groove, and if desired in such a fashion that the cord resides in the groove and vents down the other side of the bar so that the hook-like member may be hooked over the projection extending outwardly from the rear portion of the bar. A U-shaped element, having a relatively short legs is provided with the apparatus such that this U-shaped element is equipped with a notch, similar to the notch of the T-shaped element. A projection as provided on the end of the plate opposite the pivotable ened thereof such that the U-shaped element may be removeably fixed to the plate. The free ends of the legs of the U-shaped element are directed towards the U-shaped bar and more specifically towards the plane in which the longitudinal axis of the bar resides. The helical spring, affixed to the plate, causes the end of the U-shaped element move backwardly towards the bar in a constantly biased condition. The T-shaped element has a pair of sheets pivoted there too along pivot axis located in the other portion of the cross member adjacent to the portion of the cross member which is notched for clearance around the girth of the bar. One end of each of the sheet-like members are grooved so as to permit an elastic member, such as a rubber band to be engaged therein and causing the other ends of the sheet-like members to be spread apart in constant fashion. The ends of the cross member of the T-shaped bar carrying the notch therein are bent downwardly so as to prevent the sheet members from being able to pivot in an uncontrolled fashion thereby limiting the distance apart that the ends of the sheet members extend. The apparatus, when assembled, may then rest upon a horizontal supporting surface by having the end of the bar which does not carry the groove and is cut angularly relatively to the longitudinal axis of the bar in the ends of the sheet members which are not grooved and communicating with the elastic member rests on the supporting surface. In such a position the longitudinal axis of the bar extends at an angle inclined above the lateral surface of the supporting surface. Attached to the front portion of the bar, such portion carrying the projection used to affix the T-shaped element thereto, is a curved sheet which has the edges thereof extend forwardly toward the U-shaped element in complimentary fashion. Such curved sheet is utilized to support the outermost portions of a spine of a book, supported by the apparatus, providing an inclined supporting surface on which such spine portions may nestle. The bar is also provided with a plurality of holes distributed about along its length as well as a notch leading to a hole in the end of the bar which is cut at an angle relative to its longitudinal length. These holes and notched hole may be utilized for making the present invention in a stand apparatus when it is desired not to use the sheet-like element for supporting purposes.

In use, the apparatus is assembled and allowed to rest on a supporting surface or are allowed to be carried by a stand mechanism. A book is opened to have its leafs separated in approximately an equal distribution on each half of its cover and positioned so that the lower most marginal edges of the cover and pages rest on the cross member of the T-shaped bar that extends outwardly from the bar. The hook-like member is disengaged from its engaging projection so that the cord-like element is permitted to engage the spine of the book, intermediate the leaves of the pages and pulled upwardly over the top of the book having portions of the cord member engage the groove at the end of the bar carrying it and then having the hook-like member engage its supporting projection. In so doing the elastic member attached to the cord is stretched causing tension in the cord and permitting the cord to clamp the spine of the book to the surface of the board carrying the curved plate. The spine of the book and portions of the external surface of the covers engage the curved plate keeping the book in a secure position. It is to be noted that the cord passes through the notch which engages the notch used to support the T-shaped member to the bar thus allowing the cord to capture the entire length of page extending from the bottom of the page through the top thereof. The free ends of the U-shaped member engage the pages in an open position and cause the pages to be clamped tight against the underlined pages thereof. When it is desired to turn pages an overriding manual force is applied to the U-shaped member in a general outwardly and downwardly direction such that the free ends of the U-shaped member disengage from the pages permitting a page to be turned in either direction and after the completion of the page turning operation the U-shaped member is simply released, causing the helical spring to urge the U-shaped member toward the plane of the longitudinal axis of the bar reclamping the pages in their now turned position. This operation may be repeated endlessly without the cord interfering in the page turning operation. Because of the thinness of the cord the pages may be accumulated on one side or the other of the T-shaped member, about its median regions, with ease.

Upon disassembly, the T-shaped member is removed from the projection supporting it to the bar and the sheet-like members are folded up so that a substantial force is exerted on the elastic member joining the notched ends of the sheet member. A toggle-like force is exerted on the elastic member attached to the sheet-like members and the length of the sheet-like members are used to extend parallel to the length of the T-shaped bar in a storage condition. The U-shaped member is simply disengaged from its supporting projection. The hook-like member is reclamped onto its carrying projection. Three major assemblies comprising the invention may then be stored in an elongated box.

Now referring to the figures, and more particularly to the embodiment illustrated in FIG. 1 showing the present invention 10 utilizing an elongated bar member 12 and a T-shaped member 14. A U-shaped member 16 is shown affixed to a plate member 18. The T-shaped member is equipped with a pair of sheet-like members 20 and 22. A cord member 24 is shown coupled to an elastic member 26 which in turn is connected to a hook-like member 28. Dotted lines 30 depicted a book having pages 32 and 34 thereof shown in an open position. The spine of the book is shown resting upon a curved plate 36, affixed to bar 12. Plate 18 is shown pivotably affixed to bar 12 utilizing pivot rod 38 therefore. Rubber band 40 acts as a spring, having end 42 thereof secured to the bar and end 44 thereof engaged at the other end of plate 18. Projection 46 engages notch 48 located in the center of U-shaped member 16. Ends 50 of U-shaped member 16 engages pages 32 and 34 adjacent to the lower most marginal edges of the book. Sheet-like members 20 and 22 are coupled together by an elastic member 52 similar to a rubber band, engaged within notches 54 at one end of the sheet-like members. Rivets 56 are utilized to pivotably secure sheet-like members 20 and 22 to one portion 58 of a cross member of the T-shaped bar. The remaining portion 60 of the cross-member of the T-shaped bar is provided with downwardly projected ends 62 with prevent the unlimited displacement of end 64 of sheet-like member 20 and 22. Projection 66 is affixed to bar 12 and extends outwardly therefrom from surface 68. Projection 66 may be of screw-like construction and is engaged into notch 70 located in leg member 72 of T-shaped member 14. Thus, T-shaped member 14 may be disengaged from bar 12 by sliding notch 70 downwardly, disengaging projection 66. Cord member 24 has end 74 thereof secured to bar 12. Cord 24 extends over surface 68 and over curved plate member 36 into groove 76 located at end 78 of bar 12. Cord member 24 is affixed to elastic member 26 at point 80. Hook member 28 is affixed to elastic member 26 at point 82. The hook member is provided with hole 96 that is used to removably engage hook member 28 over projection 84. Projection 84 is located on an opposite surface 68 of bar member 12. Screws 86 are used to secure curved sheet 36 to surface 68 of bar 12. Holes 88 are utilized to fasten bar 12 to the stand, not shown, as is hole 90, communicating with notch 92.

Figure 2:
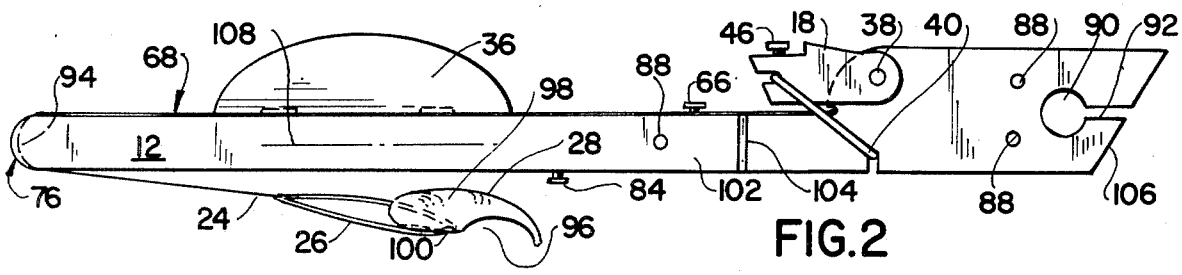
FIG. 2 is a side elevation view of the bar portion of the present invention.

FIG. 2 illustrates bar 12 having cord 24 shown attached to elastic member 26. Cord 24, has a portion thereof illustrated by dotted lines 94, shown engaged within groove 76. Curved plate 36 is shown extending beyond surface 68. Hook member 28 is shown having leg portion 98 thereof as well as portion 100, connecting another leg-like member, not shown, residing behind and parallel to leg member 98. Hole 96 engages projection 84 when leg member 98 is positioned so as to straddle surface 102 of bar member 12 having the leg member which is not shown straddling the surface parallel to surface 102. Groove 104 may be provided on surface 102 to accommodate leg portion 60 of T-shaped member 14, as shown in FIG. 1. Marginal edge 106 of bar 12 is shown residing at an angle relative to the longitudinal axis of bar 12. The longitudinal axis of bar 12 is shown by dotted line 108.

Figure 3:
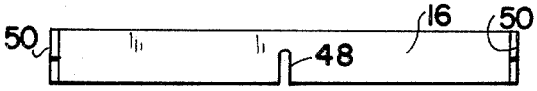
FIG. 3 is a plan view of the U-shaped element of the present invention.

FIG. 3 illustrates U-shaped member 16 having ends 50 thereof displaced equally distantly from notch 48.

Figure 4:
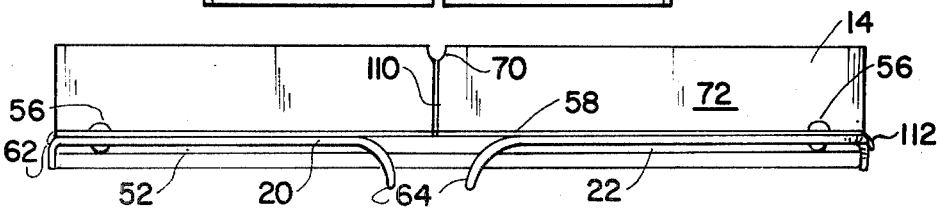
FIG. 4 is a front elevation view of the T-shaped element of the present invention.

FIG. 4 shows T-shaped member 14 having leg 72 thereof provided with notch 70. Notch 70 has an elongated portion 110 provided for a portion of cord member, not shown, to pass there through thus permitting the cord member to reside on surface 68 of bar 12, not shown, when elastic member 26, not shown, is stretched taut. Sheet members 20 and 22 are shown in a folded up condition and pivoting around rivets 56 at opposite ends of T-shaped member 14. A book holder utilizes a elongated bar having a T-shaped member removable secured to it and when secured the T-shaped member extends at right angles to the length of the bar. A book may be rested on the leg portion and half of the cross section of the T-shaped member such that the spine of the book rests upon a portion of the length of the bar. The book is maintained secured to the bar and T-shaped section by a cord which rests between leafs of the book such that the cord would be removably affixed to the bar by way of an elastic member coupled to the cord and a hook-like element removably affixed to the bar.

One of the advantages of the present invention is to provide a book holder apparatus which when collapsed occupies a minimum of space and when assembled effectively holds books of a wide variety of sizes in an efficient manner.

Another advantage of the present invention is to provide a book holder which successfully holds the book pages to be later easily freed for a turning operation.

Still another advantage of the present invention is to provide a book holder which holds a book without engaging the space between the cover of the book and the spine of the pages. It is highly undesirable to disengage books of the paperback, bound or sheet music variety.

Yet another advantage of the present invention is to provide a book holder which has a component adapted to securely hold the pages of the book in an open fashion without interferring with the indicia carried by the pages.

Another advantage of the present invention is to provide a book holder whose page engaging apparatus may be easily manipulated to permit pages of the book to be turned.

Still another advantage of the present invention is to provide a book holder which supports the book in an inclined plane in a clapped position to the holder regardless of the location of page holding portion thereof.

Yet another advantage of the present invention is to provide an apparatus which engages the spine of the book easily and effectively independent of the displacement of the pages from side to side, thus minimizing the need to reclamp the book to the holder when a large number of pages has been shifted from one side to another.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

1. A book holder comprising a bar, an elongated T-shaped element, a plate, one end of said plate pivotably secured to said bar, means to bias the other end of said plate towards one end of said bar, a U-shaped element, means to removably affix said U-shaped element to said plate, said U-shaped element having legs, the free ends of said legs being disposed directed towards a plane in which said bar resides when said U-shaped element is affixed to said plate, means to removably affix said T-shaped element to said bar such that the longitudinal axis of said T-shaped element extends normally to the longitudinal axis of said bar, a cord, one end of said cord being affixed to said bar at a location intermediate said T-shaped element when affixed to said bar and said other end of said bar, hook-like element, an elongated elastic member, a first portion of said elastic member secured to said hook-like element, a second portion of said elastic member affixed to the other end of said cord, said bar having a projection on an exterior surface thereof, said projection being located intermediate said one end and said other end of said bar on a surface thereof opposite a surface carrying said means to affix said T-shaped element to said bar, said T-shaped element having a leg portion and a cross element portion, said leg portion of said T-shaped element being disposed intermediate said cross-element portion of said T-shaped element and said one end of said bar when said T-shaped element is affixed to said bar.

2. The apparatus as claimed in claim 1 further comprising a plate like member, said plate like member secured to said bar at a location intermediate said one end of said plate and said other end of said bar.

3. The apparatus as claimed in claim 1 wherein said means to affix said T-shaped element to said bar comprises a projection affixed to said bar, said leg portion of said T-shaped bar having a notch therein, said notch of said leg portion of said T-shaped bar being disposed midway between the ends of said T-shaped bar, said projection affixed to said bar having a portion thereof complementary shaped to said notch.

4. The apparatus as claimed in claim 1 further comprising a groove, located in said bar, said groove being disposed in said bar at said one end thereof, said groove residing in a plane containing said longitudinal axis of said bar.

5. The apparatus as claimed in claim 1 further comprising a pair of elongated plates, said pair of elongated plates being disposed pivotably secured to said T-shaped elements, one end of each of said elongated plates being biased toward one another by another elastic member removably secured and communicating between said one end of each of said elongated plates.

6. The apparatus as claimed in claim 1 further comprising said T-shaped element having an elongated notch located in said leg portion thereof, the longitudinal axis of said elongated notch being disposed normal to said longitudinal axis of said T-shaped element.

7. The apparatus as claimed in claim 1 wherein said plate-like element comprises an exterior surface thereof having a curved shape.

* * * * *